United States Patent [19]

Orpen

[11] 4,295,568

[45] Oct. 20, 1981

[54] PRESSURE FRAME WITH BOWED SIDE MEMBERS

[76] Inventor: Kenneth S. E. Orpen, 2 Oak Lodge La., Westerham, Kent, England

[21] Appl. No.: 64,825

[22] Filed: Aug. 8, 1979

[30] Foreign Application Priority Data

Aug. 15, 1978 [GB] United Kingdom ..... 33352/78

[51] Int. Cl.[3] ..... B65D 19/00

[52] U.S. Cl. ..... 206/597; 219/66

[58] Field of Search ..... 206/597, 451, 448, 454; 219/66, 67, 68

[56] References Cited

U.S. PATENT DOCUMENTS 2,661,110 12/1953 Allavena ..... 217/66
3,225,919 12/1965 Swingle ..... 206/597
3,917,066 11/1975 Cloyd ..... 206/597

FOREIGN PATENT DOCUMENTS 2311717 5/1975 Fed. Rep. of Germany ..... 206/597
1494456 12/1977 United Kingdom ..... 206/597

*Primary Examiner*—Joseph Man-Fu Moy
*Attorney, Agent, or Firm*—Le Blanc, Nolan, Shur & Nies

[57] ABSTRACT

For palletized handling of goods a pressure frame is made from springy frame members of L-shaped section, which are all similarly tilted for two reasons: firstly to enable identical pressure frames to nest safely in storage and secondly to accommodate stretching of straps which secure the palletized goods. Two opposite side members are bowed, upwardly concave and after placing the frame around the top of a stack of goods, holding straps are put around the stack and the frame. Tightening the straps causes the frame to distort slightly, reducing the tilt of the frame members, and the bowing of the two bowed members. Owing to their resilience, the frame members tend to recover the tilt and bowing and so keep the straps tensioned, and the stack secured, despite the straps stretching slightly.

13 Claims, 7 Drawing Figures

PRESSURE FRAME WITH BOWED SIDE MEMBERS

Figure 1:
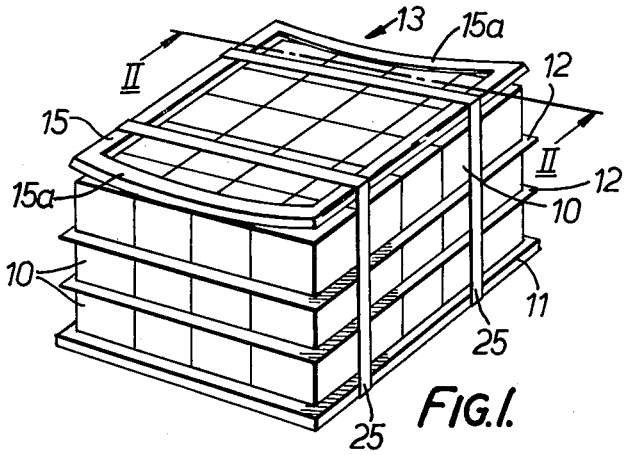

Prior Application:

Priority, Great Britain Aug. 15, 1978 Application No. 33352/78.

The present invention relates to improvements in frames for securing stacks of articles.

When a multiplicity of articles is stacked on a pallet, the articles commonly need securing in some way. One approach has been to lay a holding frame over the top of the stack and then to tie the stack together with suitable straps. Holding frames have been made from angle irons joined together; they are, however, quite bulky to store when not in use, and can easily jam together. Moreover, the use of such existing holding frames has not been entirely satisfactory, because it is not possible to tie the stack as firmly as necessary to prevent the articles moving. As a consequence of movement, the incidence of damage to fragile articles can be significant and costly.

The present invention is directed to an improved holding frame of a type which I have devised and which is four-sided and has a flange, for engaging a surface of the stack, and a depending peripheral lip, the frame being formed by four side members each of L-section and each providing a flange-defining part and a lip-defining part, the members being joined at their ends one to another so that the side members are all tilted such that when the frame is disposed horizontally, the flange is inclined upwardly away from the centre of the frame and the depending lip is inclined downwardly and outwardly. Thanks to tilting the side members, the frame is able to nest with an identical frame, thus facilitating storage.

cA frame of the foregoing type forms the subject of my U.K. Pat. No. 1,488,263.

With such a frame it is preferred that the side members should have sufficient elasticity or resilience to enable force applied thereto when securing the stack to have the effect of deflecting the side members, thereby reducing or eliminating the tilting. If tilting is eliminated, the flange and depending lip of the horizontally-disposed frame assume horizontal and vertical attitudes respectively. Reduction or elimination of the tilting is found to be especially advantageous in use, since the tendency is for the resilient side members to recover their tilted attitudes. By this means, straps used in holding the stack together can be kept under tension and undesirable stretching of the straps taken up. It is believed that the resilience of the side members and the ability of keeping the straps under tension is responsible for minimising damage to articles in the stack. Tests on stacks of frangible articles held together by such holding frames have showed a surprising reduction in breakage rate under normal handling conditions. A breakage rate of only 2–4% has been achieved, compared with 17% when conventional angle-iron holding frames are employed.

The holding frame just described possesses a potential drawback from the user's point of view, which arises from the need for laboriously applying several tensioned straps to the stack. These have to encircle the stack in such a way that tilt-reducing forces will be exerted on each of the four side members of the frame. This means that straps have to be arranged to encircle the stack from two mutually perpendicular directions, i.e. the encircling straps have to lie in mutually perpendicular planes. If tilt-reducing forces are exerted on only one pair of the opposite side members of the prior holding frame, by failing to encircle the stack from two directions at right angles, some articles in the stack are likely to be free to jostle one another during handling or transit. Jostling can cause damage to fragile articles.

An object of my present invention has been to devise a holding frame, of the type hereinbefore defined, permitting of less stringent strapping requirements without sacrificing the security with which articles may be held in the stack.

According to the present invention, there is provided a holding frame as hereinbefore defined, for use in securing a stack of articles together, wherein two side members at opposite sides of the frames are bowed, the flange-defining parts thereof being upwardly concave when the frame is disposed horizontally, flange uppermost, the frame being elastically deformable whereby either the bowing and tilting of the said two side members is reduced or eliminated when force is applied to the other side members which reduces or eliminates the tilting of the latter side members, or tilting of the latter side members is reduced or eliminated when force is applied to the said two side members which reduces or eliminates the bowing and the tilting thereof.

Conveniently, the side members are made of a ductile metal, e.g. mild steel bent to shape. The corner joints between the ends of adjacent side members can be spot or fusion welded, rivetted or bolted. Means incorporated at the joints for establishing the tilting can take a variety of forms. For example, tapered, wedge-shaped packing pieces could be used between the meeting ends at each joint.

Preferably, however, the means establishing tilting comprise inclined end portions of flange-defining parts of the side members, the said end portions being inclined away from depending lip-defining parts of the side members, and the said end portions being secured in overlapped, face-to-face contact at each joint. The inclined end portions can be made by bending upwardly about lines extending at 45° from the ends of the side members across their flange-defining parts. Both ends of each side member are provided with an inclined end portion.

Ordinarily, with an overlapped joint between contacting end portions, one of the side members will have its underside displaced above the underside of the other meeting side member. Such displacement could be disadvantageous since it could allow some articles in a stack freedom to move. Movement may be sufficient in some cases to cause damage to particularly fragile articles.

I therefore prefer to contrive to arrange that the underside of the flange-defining portion of one of the meeting side members is substantially co-planar with a lower one of the two inclined end portions located at each corner joint. Provided the co-planar condition prevails at each corner joint, the disadvantage noted in the preceding paragraph can be overcome.

The invention also comprehends stacks of articles held together with the aid of holding frames as described in the foregoing five paragraphs. The articles can be stacked on a conventional pallet base or on a simple panel. Such a panel could be made of plywood, chipboard, corrugated board or the like. The articles can be arranged in tiers separated by similar panels.

Whereas only one holding frame is needed, at the top of the stack, another holding frame could be employed at the opposite end of the stack. The use of two holding frames can provide additional security against unwanted movement of the articles.

Preferably, the stack is secured using polyester straps, though metal straps or wires could be used instead. Only two straps or wires are necessary, though more could be used, and these are simply disposed parallel to one another and to the bowed side members. The simplified strapping arrangement enables less complex and faster-acting automatic strapping machinery to be used to advantage than has hitherto been practicable.

Figure 2:
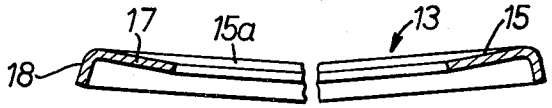
Figure 3:
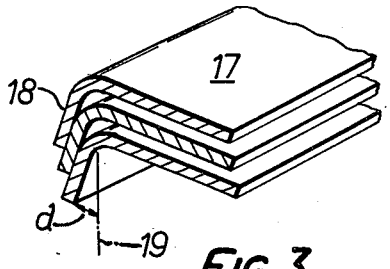
Figure 5:
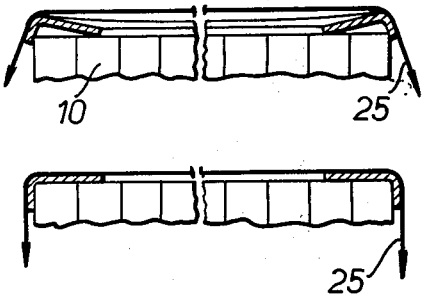
Figure 6:
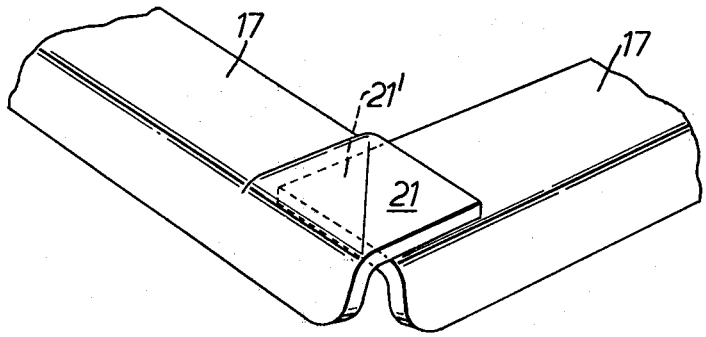
Figure 7:
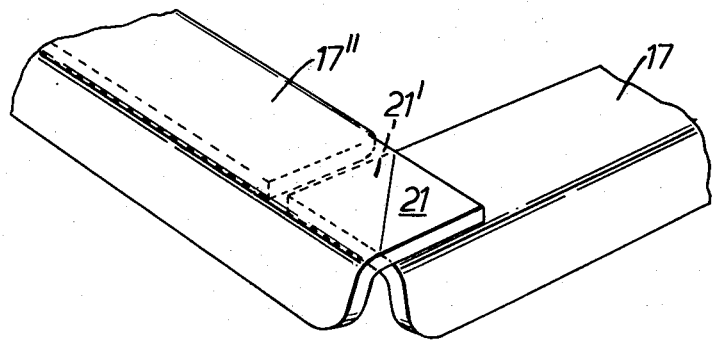

The invention will now be described in more detail by way of example with reference to the accompanying drawings, in which:

FIG. 1 is a perspective view of a palletized stack of articles secured together with the aid of a holding frame according to the invention, FIG. 2 is a sectional view through the holding frame, taken along the line II—II of FIG. 1, FIG. 3 is a fragmentary, part-sectional view illustrating the nesting of several holding frames, FIG. 4A is a fragmentary exploded view illustrating details of joints employed at the ends of the side members of the holding frame, FIG. 4B is a fragmentary view illustrating a completed joint, FIG. 5 shows two views similar to FIG. 2 showing the holding frame before and after tightening a securing strap used to fasten a stack of articles together, and FIGS. 6 and 7 are fragmentary perspective views of two preferred constructions for achieving a co-planar relationship between the underside of a flange-defining portion of a side member and the underside of a corner joint.

FIG. 1 of the drawing illustrates, somewhat diagrammatically, a stack of articles 10 supported on a base 11. The stack could alternatively be supported on a pallet. The base 11 can comprise a plywood, chipboard or corrugated board panel. The articles, which may be bottles, metal container bodies or other fragile or frangible items, are arranged in tiers separated by spacer panels 12. When the stack is complete, a snugly-fitting holding frame 13 embodying the invention is lowered over the top of the stack and the stack secured to the base 11 by straps 25.

The holding frame 13 has been designed inter alia to nest with identical frames to save space when stored.

Figure 4:
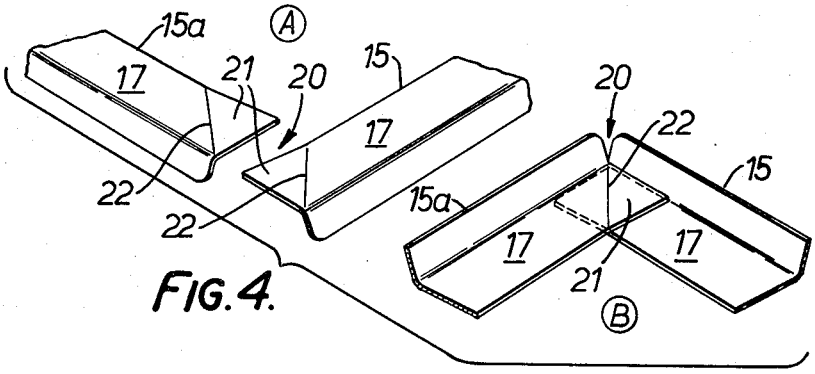

The nature of the present holding frame 13 is more clearly seen in FIGS. 2 and 4. The frame 13 comprises four elongated side members 15 secured at their ends one to another mutually at right angles. Two of members 15 at opposite sides of frame 13, i.e. members 15*a*, are bowed slightly as shown.

Each side member 15 has an L-shaped cross-section to provide a flange for engaging the top of the stack and a depending peripheral lip.

It will be seen from FIG. 2 that the side members 15 are tilted. With the frame 13 disposed horizontally as shown, flange-defining parts 17 of the frame are inclined upwardly and away from the centre of the frame. Lip-defining parts 18 of the side members 15 are inclined downwardly and outwardly. By so tilting each of the side members 15, the frame 13 and an identical frame can be nested together for storage. The flange-defining parts 17 are tilted about 5°–10° with respect to the main plane of the frame 13, e.g. at 8°. FIG. 3 shows several such frames 13 nested one within another and it will be appreciated that any number of frames can be nested together. The nested frames are free from jamming together. If stored horizontally as shown, the frames 13 need a minimum of manipulating before tilting them as shown in FIG. 1 to stacks of articles, the frames being the right way up.

The closeness with which each pair of frames 13 nest together is determined by the gauge or thickness of the side members 15 and the inclination of the lip-defining parts 18 to the main plane of each frame 13. In this example, the tilting is such that the bottom, free edge of the lip-defining part 18 is spaced a distance d (see FIG. 3) from a vertical 19 through the corner of the L-section of the horizontally-disposed frame 13, the distance d being equal to one and a half times the said gauge.

The tilting of the side members 15 is established by joints 20 at the corners of the frame 13. Two end portions of the flange-defining part 17 of each side member 15 are bent up and inclined with respect to the remainder of the flange-defining part. The inclined end portions 21 are each bent up about a line 22 crossing the flange-defining part 17 at an angle of 45° from the associated end of the side member. The angle through which each end portion 21 is bent up is arranged to give the distance d the value mentioned above. The inclined end portions 21 are each triangular in shape.

When the joint 20 is assembled as shown in FIG. 4B, the inclined portions 21 each make facial contact with an un-bent area of the flange-defining part 17 of the adjoining side member 15. The said un-bent area is located to the side of the line 22 opposite the corresponding inclined end portion 21. The two bend lines 22 at adjoining end portions 21 lie one below the other at each joint 20. The joints 20 can be welded or brazed, bolted or rivetted.

The frame 13 is somewhat resilient, and can be made from any commonly-available metal such as Duralumin (Registered Trade Mark) or mild steel, which can be in the form of strip stock. The first step in making the frame is to cut the strip to size depending on the dimensions of the stack with which the completed frame is intended to be used. The strip lengths are then bent lengthwise into L-shape and the two end portions 21 of all the L-shaped strips are bent upwardly. The L-shaped strips are assembled together and joined, e.g. by spot welding. The L-shaped strips destined to form, or forming, side members 15*a* are deformed plastically—before or after assembly with the other strips 15—to produce their bowed shapes seen e.g. in FIG. 1. The said strips are bowed by permanently stretching their lip-defining parts 18. This can be done by locally deforming the strips at intervals along their lengths. As shown, the bowing is such that the middles of side members 15*a* are depressed relative to their ends, members 15*a* being upwardly concave. The bowing is not excessive: the middle of each member 15*a* can be about ½ inch below the level of its ends for a frame having side members 15*a* approximately 3 foot 9 inches long (13 mm in 1130 mm).

In use, a stack of articles 10 is built up as shown in FIG. 1 and the frame 13 is lowered onto the top thereof. Flange-defining parts 17 rest on the stack and the lip-defining parts 18 are spaced just clear of the sides of the stack. Two or more straps 25, are placed around the stack, the base 11 and the frame 13. The straps are simply arranged in planes parallel to one another, each having a portion overlying the unbowed side members 15 which is parallel to the bowed members 15*a*. There is no need for further straps arranged overlying members 15*a* and in planes at right angles to the illustrated straps 25. FIG. 5 demonstrates what happens to the frame when the straps are tightened. When the straps are slack, the side members 15, 15*a* are all tilted and the members 15*a* are bowed, see the upper illustration in FIG. 5. Upon tightening the straps sufficiently, they forcibly reduce or eliminate the tilting of the side members 15, which they overlie or cross, thanks to the resilience of the frame. The force exerted on members 15 is transmitted through the corner joints to the bowed side members 15*a* and causes the tilting and bowing of these members to be reduced or eliminated. Strap tightening has the effect of causing the flange-defining parts 17 to engage the top surface of the stack and to move the parts 18 inwardly to embrace the stack top side surface. Owing to its resilience, the frame 13 will recover its initial shape shown in FIG. 2 when the straps are released.

The ability of the frame 13 to deform upon tightening of the straps 25 has great practical importance, particularly when non-metallic straps 25 are used. Such straps tend to stretch in time. With prior holding frames, strap-stretching has allowed the stack to work loose and has been responsible for damage to the articles 10 when jostled during transport. The ability of the present holding frame 13 to recover owing to its resilience takes up any slack developing in the straps 25. Accordingly, the straps are kept under tension and the stack of articles 10 remains firmly secured. Breakage of the articles 10 is thereby found to be kept to a low level.

The stack shown in FIG. 1 is assembled on a substantial base 11 or pallet, but could be assembled on a panel similar to the spacer panels 12 between the tiers. It may then be desirable to provide a second holding frame 13, the second frame being inverted and located at the bottom of the stack. The presence of the second frame contributes to the security of the articles 10 from accidental breakage during transport.

Experience shows that the illustrated holding frame possesses substantial advantages over, for instance, prior angle-iron frames. As mentioned earlier, the low breakage rate is attributed largely to the resiliency of the stressed frame which can accommodate stretching and slackening of the straps used to hold the stack of articles together.

It will be appreciated that a concomitant of the corner joint shown in FIG. 4 is that the undersides of the flange defining parts 17 of the meeting members 15, 15*a* are displaced from one another. This means that when the frame is placed on a stack of articles, one of the meeting parts 17 will rest on the top of the stack whilst the other is spaced-by the thickness or gauge of the strips from which the side members 15, 15*a* are made—away from the stack. The resulting gap could be sufficient for some articles of the stack to move about slightly and cause damage to themselves and neighbouring articles. Damage could be significant if the articles were fragile items of crockery or glass having damage-susceptible rims, or similarly susceptible thin-gauge container bodies intended to be used in the canning industry.

To avoid this drawback, modified constructions may be preferred in which the underside of the flange-defining part of one of the meeting side members is substantially co-planar with the lower one of the two inclined end portions 21 located at each corner joint.

One such construction is shown in FIG. 6. Here, the lower one 21' of the two adjacent end portions is accommodated in a recess formed in the flange-defining part 17' to which end portion 21' is secured in facial contact. The recess is formed by upwardly displacing or "joggling" the said part 17' locally in the region of its end. The upward displacement is sufficient to accommodate the thickness of end portion 21'. Thus, when joined to the upwardly-displaced portion of the said part 17', the underside of portion 21' will be substantially co-planar with the remainder of the underside of the said part 17'.

An alternative construction is shown in FIG. 7. In this case, the lower one 21' of the end portions is secured to the underside of the end portion of flange-defining part 17'', this end portion being of a single thickness of the material from which the side members are made. The remainder of the part 17'' is of two thickness of the said material, the flange-defining part 17'' except at its end being of a folded construction as clearly shown in the drawing.

When adopting the constructions shown in FIGS. 6 and 7, it may be convenient for the bowed side members 15*a* to have the joggled or folded forms of the flange-defining parts 17' and 17''. The lower end portions 21' will then belong to the other side members 15. The joggled construction can readily be formed in a pressing operation used to form the inclined end portions, and the folded construction can be produced by conventional sheet bending or roll-folding machinery.

It will be realised that numerous machining techniques could be employed to obtain constructions and results similar to those achieved by the constructions shown in FIGS. 6 and 7, but the latter constructions are thought to be the most economical to put into practice.

If desired, the straps 25 could be rearranged such that their tensions exert forces directly on the bowed members 15*a* instead of the members 15 as shown. When tensioned to exert sufficient force to reduce or eliminate both the tilting and bowing of members 15*a*, force will be transmitted to members 15 reducing or eliminating the tilting of these members.

I claim:

1. A holding frame as hereinbefore defined, for use in securing a stack of articles together, wherein two side members at opposite sides of the frame are bowed, the flange-defining parts thereof being upwardly concave when the frame is disposed horizontally, flange uppermost, the frame being elastically deformable whereby the bowing and tilting of the said two side members is reduced when force is applied to the other side members which reduces the tilting of the latter side members.

2. A frame according to claim 1, wherein the said other side members are unbowed.

3. A frame according to claim 1 or claim 2, wherein the side members are bowed by permanently stretching the lip-defining parts thereof.

4. A frame according to claim 3, wherein the said lip-defining parts are permanently stretched by locally deforming the side members at intervals along their lengths.

5. A frame according to claim 1, wherein corner joints between meeting side members incorporate means for establishing the tilting.

6. A frame according to claim 5, wherein the said means comprise inclined end portions of the flange-defining parts of the side members, the said end portions being inclined away from depending lip-defining parts of the side members, and the inclined end portions being secured in face-to-face contact with the flange-defining portions of the adjoining side members.

7. A frame according to claim 6, wherein each side member has an inclined end portion at each of its opposite ends, and each end portion is bent about a line extending at 45° from the end of the side member across its flange-defining part.

8. A frame according to claim 6, wherein the underside of the flange-defining portion of one of the meeting side members is substantially co-planar with a lower one of the two inclined end portions located at each corner joint.

9. A frame according to claim 8, wherein the said flange-defining portion is locally upwardly displaced to form a recess for accommodating the thickness of the lower one of the end portions.

10. A frame according to claim 9, wherein the opposite ends of each of the two bowed side members are upwardly displaced, to receive the inclined end portions of the other side members.

11. A frame according to claim 8, wherein two of the opposite side members have the inclined end portions of the other side members secured to the undersides of their flange-defining portions, their respective flange-defining portions between their ends being of folded construction and twice as thick as the ends of the flange receiving portions to which the said end portions are secured.

12. A frame according to claim 1, wherein the flange-defining parts of the side members are tilted by 5°–10° with respect to the main plane of the frame, and the lip-defining portions are substantially at right angles to the flange-defining portions.

13. A holding frame according to claim 1, in use holding a stack of articles held together with the aid of encircling, tensioned straps, said straps having portions which extend parallel to the bowed side members only and the tension therein being sufficient to reduce the tilting of all the side members and to reduce the bowing of the bowed side members.

* * * * *